US005232156A

United States Patent [19]

Csordas et al.

[11] Patent Number: 5,232,156

[45] Date of Patent: Aug. 3, 1993

[54] SELF-CLEANING SPRAY NOZZLE AND HEADER SYSTEM

[76] Inventors: Endre Csordas, 225 E. Shorewood Ct., No. 12, Vernon Hills, Ill. 60061; David W. Lambert, Rte. 2, Box 235, Grafton, W. Va. 26354

[21] Appl. No.: 853,816

[22] Filed: Mar. 19, 1992

[51] Int. Cl.[5] ..... B05B 15/02; B05B 1/14

[52] U.S. Cl. ..... 239/117; 239/106; 239/107; 239/460; 239/550

[58] Field of Search ..... 239/104, 106, 107, 117, 239/550, 460

[56] References Cited

U.S. PATENT DOCUMENTS

| | | | |
|---|---|---|---|
| 394,920 | 12/1888 | Hallowell | 239/107 |
| 436,762 | 9/1890 | Wallace | 239/107 |
| 684,676 | 10/1901 | Comins | 239/107 |
| 843,945 | 2/1907 | Hoover | 239/107 |
| 1,088,318 | 2/1914 | Bicalky | 239/107 |
| 1,295,922 | 3/1919 | Pettit | 239/107 |
| 1,602,845 | 2/1925 | Burhorn | 239/107 |
| 1,758,119 | 5/1930 | Moon | 239/107 |
| 2,260,301 | 10/1941 | Cushman | 239/118 |
| 2,267,992 | 12/1941 | Palmer | 239/107 |
| 3,384,307 | 5/1968 | Moen | 239/107 X |
| 3,797,755 | 3/1974 | Saisho | 239/550 X |
| 3,807,633 | 4/1974 | Baker | 239/550 X |
| 4,079,762 | 3/1978 | Hanson, Jr. | 239/460 X |
| 4,280,054 | 5/1981 | Parker | 239/107 |

FOREIGN PATENT DOCUMENTS 2177621 1/1987 United Kingdom ..... 239/107

OTHER PUBLICATIONS

Albany Engineering Systems (AES) Brochure, "New Broughton High Pressure Type 42 and 43 Purgable Shower Systems," Feb. 1982.

*Primary Examiner*—Andres Kashnikow
*Assistant Examiner*—William Grant
*Attorney, Agent, or Firm*—Richard C. Litman

[57] ABSTRACT

A self-cleaning spray nozzle and header system sprays liquid upon a predetermined area. As the liquids employed in such spraying operations are often contaminated by suspended particulate matter, blockages of the small nozzle orifice often occur. To clear such blockages and restore the nozzle to operation, a grooved piston forming part of the nozzle orifice is retracted from its seated position within the nozzle barrel. Once the piston is retracted, the barrel opens to its full diameter allowing lodged particles to be flushed away. Several nozzles mounted in tandem upon a fluid distribution pipe form part of a header system which can deliver, in the form of spray, large liquid volumes. The header system allows the self-cleaning function of several nozzles to be efficiently controlled by a single apparatus.

11 Claims, 3 Drawing Sheets

SELF-CLEANING SPRAY NOZZLE AND HEADER SYSTEM

FIELD OF THE INVENTION

The present invention relates to fluid delivery devices from which fluid is emitted in a jet or a spray and, more particularly, it relates to such a device having a novel and improved spray nozzle which includes a means for self-cleaning of the nozzle orifice of lodged particles therein. The present invention is herein illustrated as embodied in a device for delivering a spray of water for the rinsing of mineral aggregates. It will be recognized, however, that the present invention is not limited to rinsing operations and may be adapted to various uses.

BACKGROUND OF THE INVENTION

Environmental regulations promulgated by government in addition to economic reality have forced mineral producers to recycle water employed in mining and mineral processing operations. Unfortunately, even the most diligent efforts cannot consistently remove all particulates from the liquid flow stream. As a result, mineral aggregate washing systems have been plagued with nozzle clogging problems.

Numerous nozzle designs have been developed in the past to obviate such problems. Nevertheless, individual handling of each nozzle by a human operator has been required to clean a blocked nozzle orifice of unwanted debris. Over time, such designs have proved to be extremely inefficient.

The need has arisen for a nozzle not susceptible to being clogged by particulate matter suspended in the fluid passing through it. Additionally, the nozzle must have the capability of readily allowing the removal of clogging particulates without human intervention. Finally, this nozzle must be capable of being securely mounted to a fluid header system capable of delivering large fluid volumes through a series of like nozzles mounted side-by-side. Such a device would prove to be of benefit to the mineral industry.

DESCRIPTION OF THE RELATED ART

Several attempts have been made in the past to alleviate the problem of clogged spray nozzles. However, each solution possesses unique drawbacks. One such solution utilizes a spray nozzle wherein a tapered plug with an orifice forming notch is fitted in the end of a fluid delivery pipe. In order to unclog or clean the nozzle, a lever biased by a spring and attached to the plug must be grasped by the hand and pulled. An example of such a device is contained in U.S. Pat. No. 428,054 to E. W. Parker on May 13, 1890. An obvious problem with such a device is that it requires human intervention to unclog or clean the blocked orifice. Additionally, such a device is incapable of handling high fluid flow rates due to inherent mechanical limitations of the biasing spring.

Another solution, invented by M. V. Wallace and disclosed in U.S. Pat. No. 436,762, granted Sep. 16, 1890, shows an early humidifier fitted with a notched and tapered plug biased by a compressed spring located within the fluid delivery pipe and in the fluid flow stream. The plug may be removed from its seat in the fluid delivery pipe by movement of a pivoted finger joined to the external surface of the same pipe. An obvious problem with such devices is that the biasing spring, since it is located within the fluid delivery pipe, is difficult to adjust, replace, and is subject to corrosion in an environment surrounded by water.

Another solution, developed by F. B. Comins and illustrated in U.S. Pat. No. 684,676, granted Oct. 15, 1901, eliminates the wire springs employed in the former inventions. Comins uses a pivoting finger activated by a cam to move a tapered valve, having on its periphery a series of channels, against the flow of fluid through the nozzle to clear unwanted debris. Unfortunately, the narrow grooves found in the tapered valve limit its use to delivering relatively small amounts of fluid and is prone to become rapidly blocked by fluids with a high particulate content.

An additional development in the art is attributable to Edwin Burhorn who was granted U.S. Pat. No. 1,602,845 for a spray nozzle on Oct. 12, 1926. This particular patent discloses a nozzle fitted with a conically shaped, hinged and weighted piston which utilizes gravity to hold the piston within the fluid flow stream. This piston may be pivoted about its hinge when a lateral force is delivered to an attached and upstanding lever or arm allowing the dislodgement of any clogging matter in the orifice formed between the piston and its seat. Obviously, such a nozzle is capable of being installed in one plane only: vertical.

Finally, U.S. Pat. No. 2,260,301 granted to L. H. Cushman on Oct. 28, 1941 discloses a nozzle having a slotted piston which automatically withdraws from the nozzle orifice in response to an increase in nozzle fluid pressure caused by an obstruction to fluid flow. Large particulates may become lodged between the piston and its seat. Once firmly lodged in place, the nozzle will no longer close this preventing the desired fluid jet or spray from forming at the orifice. At this point, human intervention becomes necessary to clear the device.

None of the above inventions and patents, taken either singly or in combination, is seen to describe the present invention as claimed.

SUMMARY OF THE INVENTION

By the present invention, an improved spray nozzle and header system for use in rinsing current mineral aggregates and the like is disclosed.

Accordingly, it is the principal object of the invention to provide a spray nozzle such that the tendency of the nozzle orifice to become clogged will be overcome to a large extent.

It is another object of this invention to so construct a spray nozzle wherein the nozzle orifice may be readily split mechanically releasing lodged or clogging matter therein.

It is a further object of this invention to so construct a spray nozzle such that the mechanical splitting of its nozzle orifice may be regulated by a timing mechanism.

Still another object of the present invention is to provide a spray nozzle wherein the nozzle orifice is self-cleaning of lodged or clogging matter therein.

Another object of the invention is to so construct a spray nozzle where a series of such nozzles are linearly mounted upon the fluid delivery pipe whereby the nozzles may be activated by a mechanism activated therewith.

It is another object of the present invention to so construct a spray nozzle where a series of such nozzles are linearly mounted upon a fluid delivery pipe whereby the fluid is directed therefrom by diffusers in overlapping spray patterns to mineral aggregate placed beneath such.

It is the object of the invention to provide improved elements and arrangements thereof in an apparatus for the purposes described which is economical, dependable and fully effective in accomplishing its intended purposes.

These and other objects of the present invention will become readily apparent upon further review of the following specification and drawings.

DESCRIPTION OF THE PREFERRED EMBODIMENT

Figure 1:
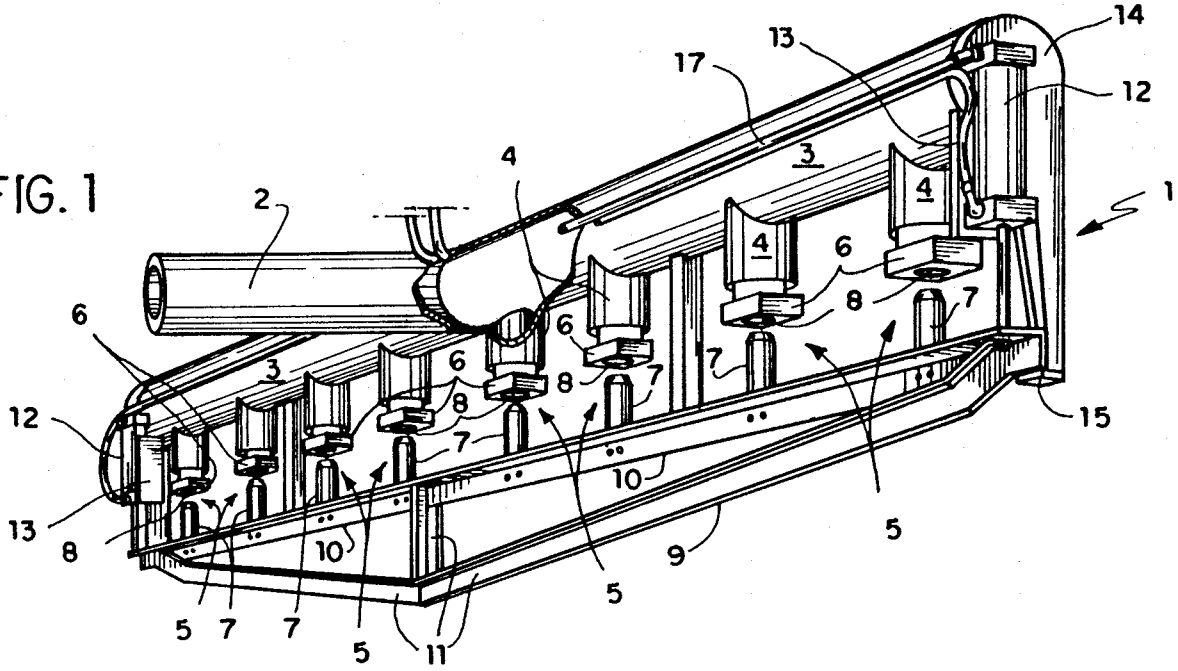
FIG. 1 is a perspective view of a self-cleaning spray nozzle and header system, piston retracted from barrel for self-cleaning, a portion of the structure being broken away.

Referring now to the drawings, there is shown in FIG. 1 a self-cleaning spray nozzle and header system 1 adapted for spraying liquids such as water. This particular device may be attached to a liquid carrying conduit 2. Traveling from a high pressure source, liquid entering the device is channeled by fluid distribution pipes 3 to fluid outlet pipes 4 and finally to self-cleaning spray nozzles 5. The preferred embodiment has eight self-cleaning spray nozzles 5; however, similar devices could be constructed with a greater or lesser number of such nozzles 5 and associated outlet pipes 4. Each spray nozzle 5 is assembled from several components, among them visible in FIG. 1: a barrel 6 fastened to an outlet pipe 4; a longitudinally grooved piston 7 which may be inserted into a fluid bore 8 found in the barrel 6, the channel created between the walls of the piston's groove 27 and the interior walls of the barrel 6 forming an orifice when the self-cleaning spray nozzle and header apparatus 1 is employed in spraying operations as is more clearly seen in FIG. 4; and, a diffuser rack 9 for moving the piston 7 axially into and out of the fluid bore 8. The diffuser rack 9 is constructed in the form of a triangularly shaped truss with an L-shaped control bar 10 forming the base of the triangle and reinforcement bars 11 forming the remainder. Movement of the diffuser rack 9 is accomplished by two double-acting pneumatic air cylinders 12 mounted to plates 13 attached to the substantially circular end caps 14 of the fluid distribution pipes 3. In the preferred embodiment of the self-cleaning spray nozzle and header system 1, air is the fluid which drives the pneumatic cylinders 12. Nonetheless, it is foreseen that numerous suitable fluids (e.g., inert gases or nitrogen) may be utilized for this purpose. The end caps 14 are extended in a plane substantially parallel with the fluid outlet pipes 4 and have a flange or stop 15 to prevent excess travel of the diffuser rack 9.

Figure 2:
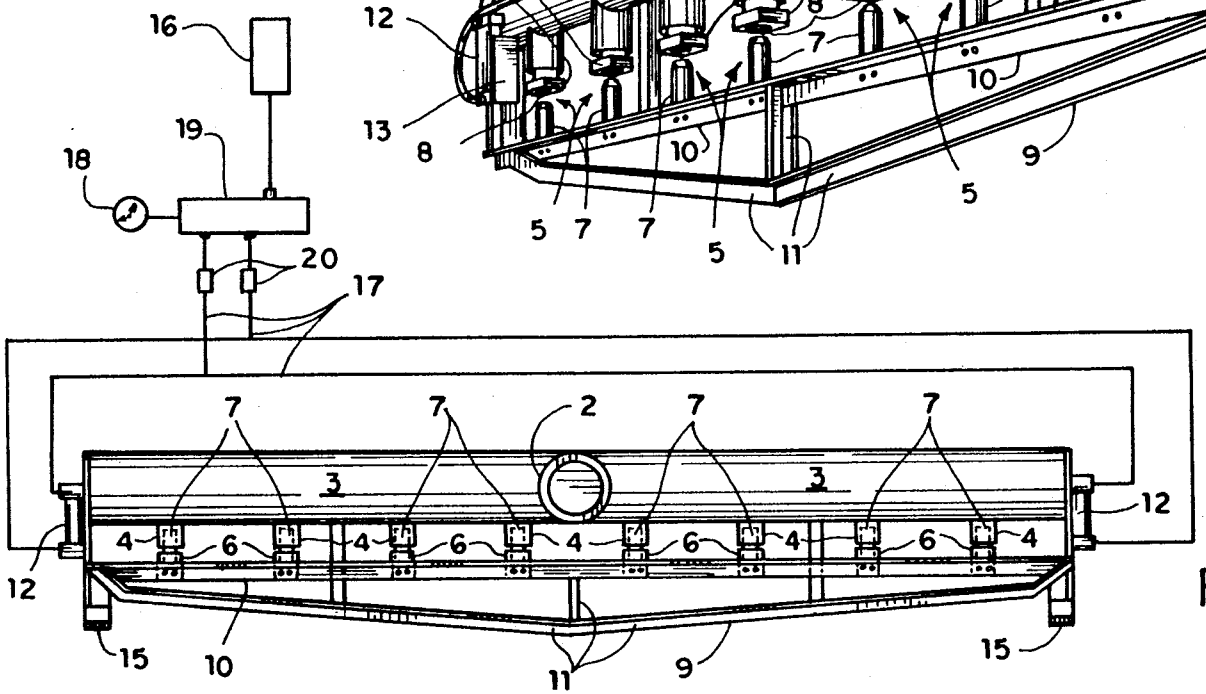
FIG. 2 is a partially schematic, top view of the self-cleaning spray nozzle and header system.

FIG. 2. clearly shows the mechanism which controls the operation of the double-acting pneumatic cylinders 12. A compressed air supply 16 is connected by air flow lines 17 to the pneumatic cylinders 12. When air is directed from its supply 16 to either port of the double-acting pneumatic cylinders 12, motion of the diffuser rack 9 results. FIG. 2 clearly shows the diffuser rack 9 in the "plan" position with each piston 7 inserted within its corresponding barrel 6 as the header system would appear when it was being employed in spraying operations. The timing of the movement of the diffuser rack 9 may be preset into a timer 18. This timer 18, in turn, activates solenoid 19 opening or closing permitting compressed air to flow through valves 20 and to either side of the double-acting cylinders 12 effectuating movement of rack 9.

Figure 3:
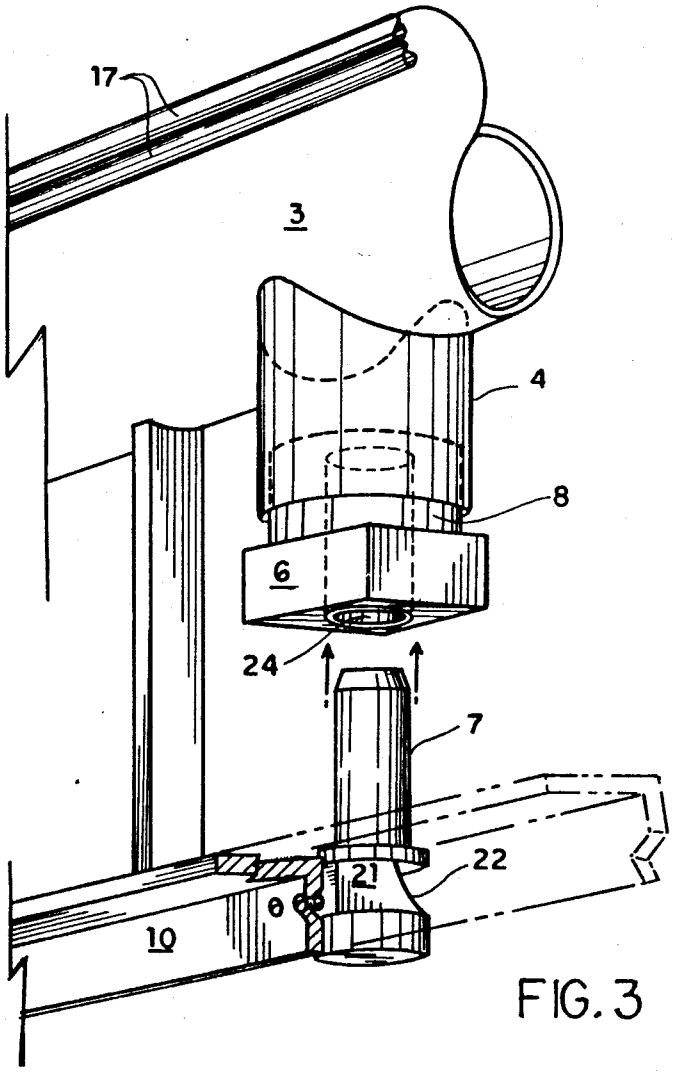
FIG. 3 is a fragmentary perspective view of a self-cleaning spray nozzle and header system with the spray nozzle in cleaning position.
Figure 5:
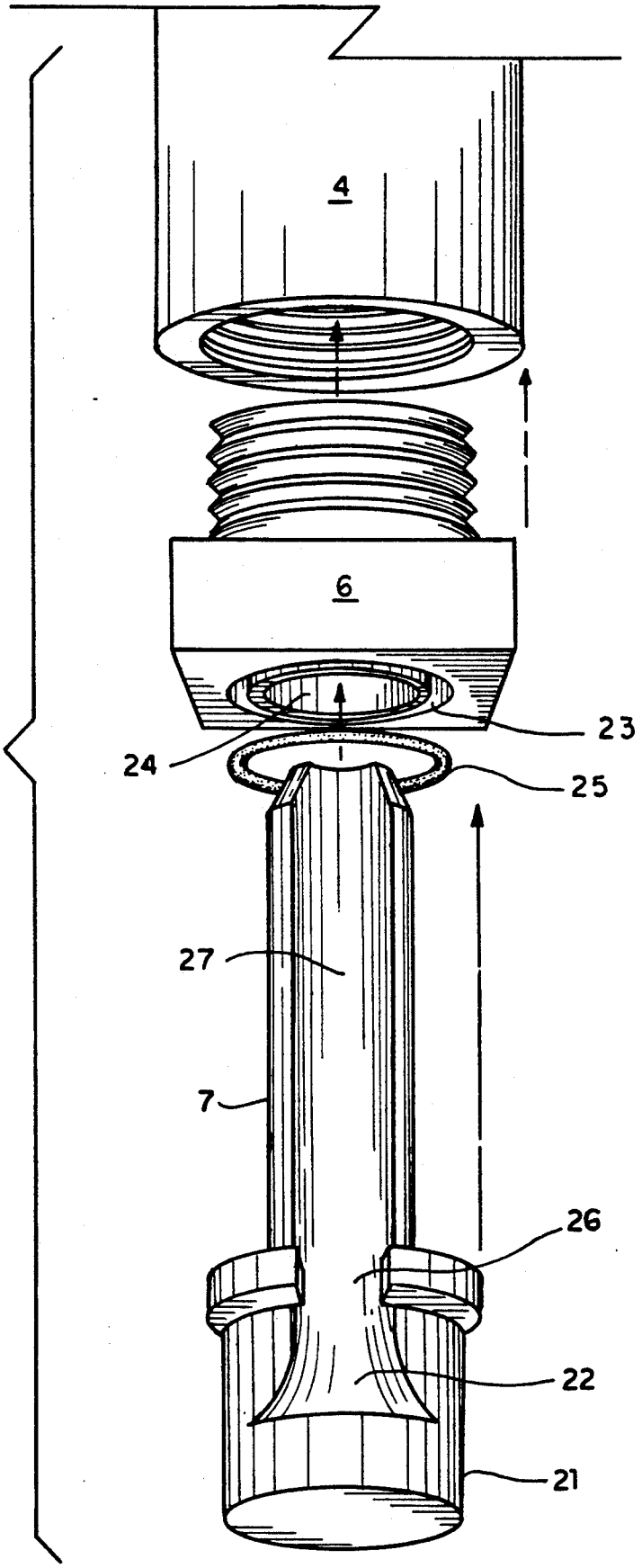
FIG. 5 is an exploded perspective view of a self-cleaning spray nozzle.

FIG. 3 shows a single self-cleaning spray nozzle 5 with much of the surrounding header system cut away to expose its detail. Here the piston 7 has been retracted from the fluid bore 8. The nozzle 5 would appear in this position when the fluid bore 8 was being flushed during self-cleaning operations. In this manner, the fully opened flow orifice 24 permits trapped solids to fall under the force of gravity from the nozzle 5 or to be flushed from same by the spray liquid. The diffuser 21 joined to the piston 7 also appears in this figure. The diffuser 21 has a notch 26 cut therefrom of a shape substantially similar to that of the groove 27. The notch 26 permits spraying liquids to contact ramp 22 directing such liquids to a desired target in a fan shaped spray pattern.

Figure 4:
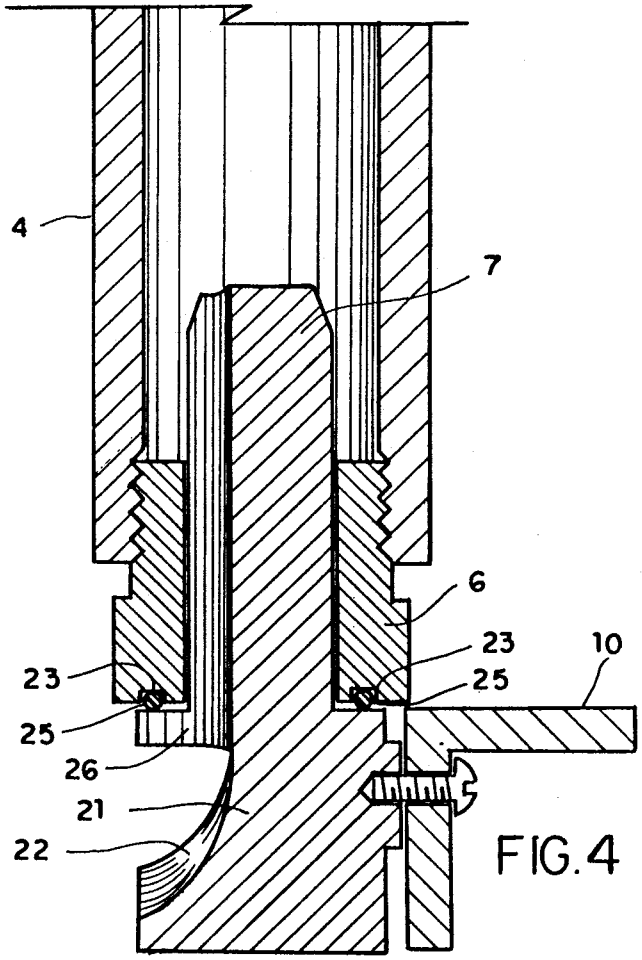
FIG. 4 is a cross-sectional view of a self-cleaning spray nozzle in spraying position.

FIG. 4 shows a sectional view of a self-cleaning nozzle 5 as it would appear when spraying operations are undertaken. A circular furrow 23 laterally spaced from and surrounding the spray opening 24 at the termination of the fluid bore 8 accepts a circular O-ring sealing element 25 made of rubber or other polymeric substance well known in the valve and nozzle art. This sealing element 25 prevents liquid leakage during spraying operations. Details of the diffuser 21 may also be viewed.

It is to be understood that the present invention is not limited to the sole embodiment described above, but encompasses any and all embodiments within the scope of the following claims.

We claim:

1. A self-cleaning spray nozzle for use with a spray device attached to a liquid carrying conduit, said spray nozzle comprising:
- a barrel adapted to be secured to the spray device, said barrel having a fluid bore communicating with the conduit and terminating in a spray opening;
- a piston having a groove, said piston fitted within said fluid bore;
- a diffuser joined to said piston for directing pressurized liquid emitted from said spray opening;
- a means for retracting said piston from said fluid bore, said means adapted to be attached to the spray device, whereby debris lodged within said barrel can be flushed from said fluid bore when said piston is retracted;

said means for retracting comprising:
- a ram means adapted to be secured to the spray device;
- said ram means including a double-acting pneumatic cylinder;
- said double-acting pneumatic cylinder being actuated by compressed aid;
- a diffuser rack joined to said ram means and upon which said diffuser is mounted;
- a means for activating said ram means to thereby move said diffuser rack;

said means for activating said ram means including:
a compressed air supply attached by air flow lines to said double-acting pneumatic cylinder;
a flow restriction valve means connected to said air flow lines to regulate the flow within said lines;
a solenoid means for controlling flow to said valve means; and
a timer means controlling said solenoid means,
whereby introduction of air into said double-acting pneumatic cylinder moves said diffuser rack, retracting said piston from said fluid bore, said timer means being preset to activate said solenoid means to flush and clean said nozzle.

2. The self-cleaning nozzle of claim 1 wherein said barrel includes:
a circular furrow laterally spaced from and surrounding said spray opening adapted to receive a sealing element.

3. The self-cleaning nozzle of claim 1 wherein said diffuser includes:
a cylinder adapted to be joined to said piston retracting means and having a notch of a shape substantially similar to that of said groove in said piston and being aligned therewith, said notch opening to a ramp whereby fluid emitted from said spray opening may be directed to a desired location.

4. The self-cleaning nozzle of claim 1 wherein said diffuser rack includes:
an L-shaped control bar to which said diffuser is joined.

5. The self-cleaning spray nozzle of claim 1 wherein said diffuser is joined integrally to said piston.

6. A spray device having self-cleaning nozzles comprising:
a conduit means adapted to be attached to an inlet pipe;
a plurality of fluid outlet pipes joined to said conduit means;
a plurality of barrels including means for securing said barrels to said outlet pipes, said barrels each having a fluid bore communicating with said outlet pipes and terminating in a spray opening;
a plurality of grooved pistons, each of said pistons fitted within the fluid bore in each of said barrels;
a plurality of diffuser means each joined to one of said pistons for directing pressurized liquid emitted from each said spray opening;
a means for retracting said pistons from said fluid bores, said means for retracting being attached to said spray device, whereby retracting said pistons permits debris lodged within said barrels to be flushed therefrom;
said means for retracting comprising:
a ram means secured to said spray device;
said ram means including a double-acting pneumatic cylinder;
a diffuser rack joined to said ram means and upon which said plurality of diffuser means are mounted;
a means for activating said ram means to thereby move said diffuser rack;
said means for activating said ram means including:
a compressed air supply attached by air flow lines to said double-acting pneumatic cylinder;
a flow restriction valve means connected to said air flow lines to regulate the flow within said lines;
a solenoid means for controlling flow to said valve means; and
a timer means controlling said solenoid means,
whereby introduction of air into said double-acting pneumatic cylinder moves said diffuser rack, retracting said pistons from said fluid bores, and said timer means being preset to activate said solenoid means to flush and clean said nozzles.

7. The spray device of claim 6 wherein each said barrel includes:
a circular furrow laterally spaced from and surrounding said spray opening adapted to receive a sealing element.

8. The spray device of claim 6 wherein each said diffuser means includes:
a diffuser adapted to be joined to said piston retracting means and having a hole of a shape substantially similar to that of said groove in said piston and being aligned therewith, said hole opening to a ramp whereby fluid emitted from said fluid bore may be directed to a desired location.

9. The spray device of claim 6 wherein said diffuser rack includes:
an L-shaped control bar to which said diffusers are joined.

10. The spray device of claim 6 wherein each of said diffuser means is joined integrally to one of said pistons.

11. The spray device of claim 6 wherein said barrels have helical threads fastening each of said barrels to one of said outlet pipes.

* * * * *